US010668397B1

(12) United States Patent
Ruggiero et al.

(10) Patent No.: US 10,668,397 B1
(45) Date of Patent: Jun. 2, 2020

(54) WOUND MATERIALS TOY WITH INTERNAL FIGURES AND USER ENGAGEMENT CRAFTS

(71) Applicant: Sunny Days Entertainment, LLC, Simpsonville, SC (US)

(72) Inventors: Jim Ruggiero, Simpsonville, SC (US); Rick Mershon, Boca Raton, FL (US)

(73) Assignee: Sunny Days Entertainment, LLC, Simpsonville, SC (US)

( * ) Notice: Subject to any disclaimer, the term of this patent is extended or adjusted under 35 U.S.C. 154(b) by 0 days.

(21) Appl. No.: 16/734,766

(22) Filed: Jan. 6, 2020

(51) Int. Cl.

| | |
|---|---|
| ***A63H 3/02*** | (2006.01) |
| ***A63H 33/00*** | (2006.01) |
| ***A63H 3/52*** | (2006.01) |
| *D05B 3/14* | (2006.01) |
| *D05B 85/00* | (2006.01) |

(52) U.S. Cl.
CPC ..... *A63H 3/02* (2013.01); *A63H 3/52* (2013.01); *A63H 33/004* (2013.01); *D05B 3/14* (2013.01); *D05B 85/00* (2013.01)

(58) Field of Classification Search
CPC ... A63H 3/00; A63H 3/02; A63H 3/52; A63H 33/004; A63H 33/20; A63H 37/00
See application file for complete search history.

(56) References Cited

U.S. PATENT DOCUMENTS 1,332,750 A * 3/1920 Pierce ..... D05B 91/12 223/109 R
1,575,263 A * 3/1926 Winifred ..... A63H 3/003 446/72
2,630,654 A * 3/1953 Poen ..... A63H 33/20 446/49
4,123,872 A * 11/1978 Silva ..... A63H 3/04 428/16
6,074,711 A * 6/2000 Ghazarian ..... A44C 25/005 428/14
6,261,149 B1 * 7/2001 Moore ..... A63H 3/003 446/369
6,425,795 B1 * 7/2002 Horsfall ..... A63H 3/02 206/225
2002/0162881 A1 * 11/2002 Umanoff ..... B65D 63/12 229/89
2002/0168919 A1 * 11/2002 Perkins ..... A63H 3/005 446/369
2007/0232186 A1 * 10/2007 Shamah ..... A63H 3/005 446/369
2009/0117814 A1 * 5/2009 Magener ..... H01H 23/164 446/73
2012/0308163 A1 * 12/2012 Palmer ..... B65D 75/18 383/72

(Continued)

*Primary Examiner* — Eugene L Kim
*Assistant Examiner* — Alyssa M Hylinski
(74) *Attorney, Agent, or Firm* — Waller Lansden Dortch & Davis, LLP; Matthew C. Cox

(57) ABSTRACT

An apparatus for a wound materials toy with internal figures and user engagement crafts may include a toy figure. The apparatus may include an elongated wrapping member selectably disposed around the toy figure. The elongated wrapping member, when disposed around the toy figure, may at least partially cover the toy figure. The apparatus may include a toy accessory detachably disposed on the elongated wrapping member. The elongated wrapping member, when disposed around the toy figure, may at least partially cover the toy accessory.

1 Claim, 13 Drawing Sheets

(56) References Cited

U.S. PATENT DOCUMENTS

| | | | | |
|---|---|---|---|---|
| 2013/0097901 | A1* | 4/2013 | Cooper | A01K 15/026<br>40/299.01 |
| 2014/0101903 | A1* | 4/2014 | Tuttle | D04B 19/00<br>24/599.1 |
| 2014/0287648 | A1* | 9/2014 | Rebella | A63H 33/004<br>446/73 |
| 2016/0214777 | A1* | 7/2016 | Lombardi | B65D 71/063 |

* cited by examiner

WOUND MATERIALS TOY WITH INTERNAL FIGURES AND USER ENGAGEMENT CRAFTS

BACKGROUND OF THE DISCLOSURE

The present disclosure generally relates to children's toys, and more particularly to a wound materials toy with internal figures and user engagement crafts.

Conventional children's toys include stuffed animal figures. One of these figures may be packaged in a conventional container, such as a container that includes a plastic shell adhered to a cardboard back with the figure between the plastic and the cardboard. The toy may include accessories for the figure, which may also be packaged in the conventional packaging. After a child unpacks the toy, the packaging usually does not serve any further purpose, and the child usually discards the packaging.

This conventional toy and packaging does not provide any surprise or element of the unknown, which children often enjoy. Also, this conventional packaging does not serve any further purpose other than protecting the toy before use.

What is needed then are improvements to toy figures and crafts.

BRIEF SUMMARY

The present disclosure provides an apparatus for a wound materials toy with internal figures and user engagement crafts. The apparatus may include a toy figure. The apparatus may include an elongated wrapping member selectably disposed around the toy figure. The elongated wrapping member, when disposed around the toy figure, may at least partially cover the toy figure. The apparatus may include a toy accessory detachably disposed on the elongated wrapping member. The elongated wrapping member, when disposed around the toy figure, may at least partially cover the toy accessory.

Another object of the disclosure is to provide an apparatus for a wound materials toy with internal figures and user engagement crafts with the elongated wrapping member being selectably wrapped around the toy figure and forming a spherical ball.

A further object of the disclosure is to provide an apparatus for a wound materials toy with internal figures and user engagement crafts with a foldable covering selectably disposed around the toy figure and the elongated wrapping member being selectably disposed around the foldable covering.

Another object of the disclosure is to provide an apparatus for a wound materials toy with internal figures and user engagement crafts that provides enjoyment and surprise to a child as he or she unwraps components of the apparatus to reveal the toy accessories and the toy figure.

Another object of the disclosure is to provide an apparatus for a wound materials toy with internal figures and user engagement crafts that allows a child to play with the elongated wrapping member even after unwrapping the toy figure.

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Numerous other objects, advantages and features of the present disclosure will be readily apparent to those of skill in the art upon a review of the following drawings and description of various embodiments.

DETAILED DESCRIPTION

Figure 1:
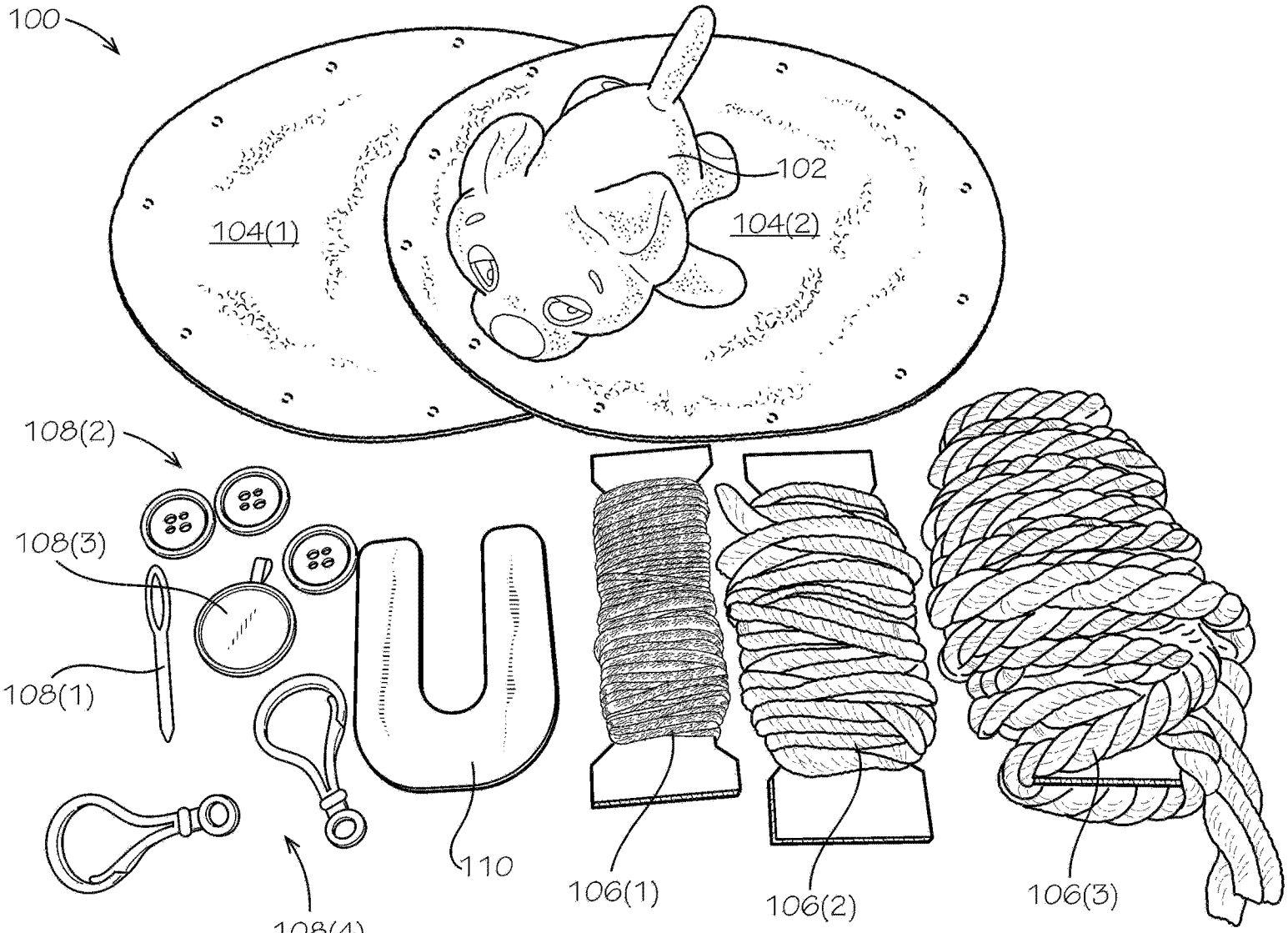
FIG. 1 is a perspective view illustrating one embodiment of an apparatus for a wound materials toy with internal figures and user engagement crafts.

While the making and using of various embodiments of the present disclosure are discussed in detail below, it should be appreciated that the present disclosure provides many applicable inventive concepts that are embodied in a wide variety of specific contexts. The specific embodiments discussed herein are merely illustrative of specific ways to make and use the disclosure and do not delimit the scope of the disclosure. Those of ordinary skill in the art will recognize numerous equivalents to the specific apparatus and methods described herein. Such equivalents are considered to be within the scope of this disclosure and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

FIG. 1 depicts one embodiment of an apparatus 100. The apparatus 100 may include a wound materials toy with internal figures and user engagement crafts. The apparatus 100 may include a toy FIG. 102. The apparatus 100 may include one or more foldable coverings 104(1)-(2). For example, as depicted in FIG. 1, the one or more foldable coverings may include a first foldable covering 104(1) and a second foldable covering 104(2). As used herein, the term "foldable covering 104" may refer to either of the first foldable covering 104(1) or the second foldable covering 104(2). If reference to a specific foldable covering 104 is needed, the term "first foldable covering 104(1)" or "second foldable covering 104(2)" is used. Similar notation is used for other elements such as the one or more elongated wrapping members 106(1)-(3) or the one or more toy accessories 108(1)-(4).

The apparatus 100 may include one or more elongated wrapping members 106(1)-(3). For example, as depicted in FIG. 1, the one or more elongated wrapping members 106(1)-(3) may include a first elongated wrapping member 106(1), a second elongated wrapping member 106(2), and a third elongated wrapping member 106(3). The apparatus 100 may include one or more toy accessories 108(1)-(4). For example, as depicted in FIG. 1, the one or more toy accessories 108(1)-(4) may include a sewing needle 108(1), one or more buttons 108(2), a name tag 108(3), or one or more carabiners 108(4). The apparatus 100 may include a toy base 110.

An elongated wrapping member 106 may be selectably disposable around the toy FIG. 102. For example, the elongated wrapping member 106 may be wound around the toy FIG. 102. The elongated wrapping member 106, when disposed around the toy FIG. 102, may at least partially cover the toy FIG. 102. A foldable covering 104 may be selectably disposable around the toy FIG. 102, and the elongated wrapping member 106 may be selectably disposable around the foldable covering 104. A toy accessory 108 may be detachably disposed on the elongated wrapping member 106. The elongated wrapping member 106, when disposed around the toy FIG. 102, may at least partially cover the toy accessory 108.

It should be noted that, as used herein, the term "disposed around" or "disposable around" may include objects being interposed between the main object and the object being disposed around the main object. For example, the elongated wrapping member 106 may be disposed around the toy FIG. 102 even if the foldable covering 104 is interposed between the toy FIG. 102 and the elongated wrapping member 106.

Figure 2:
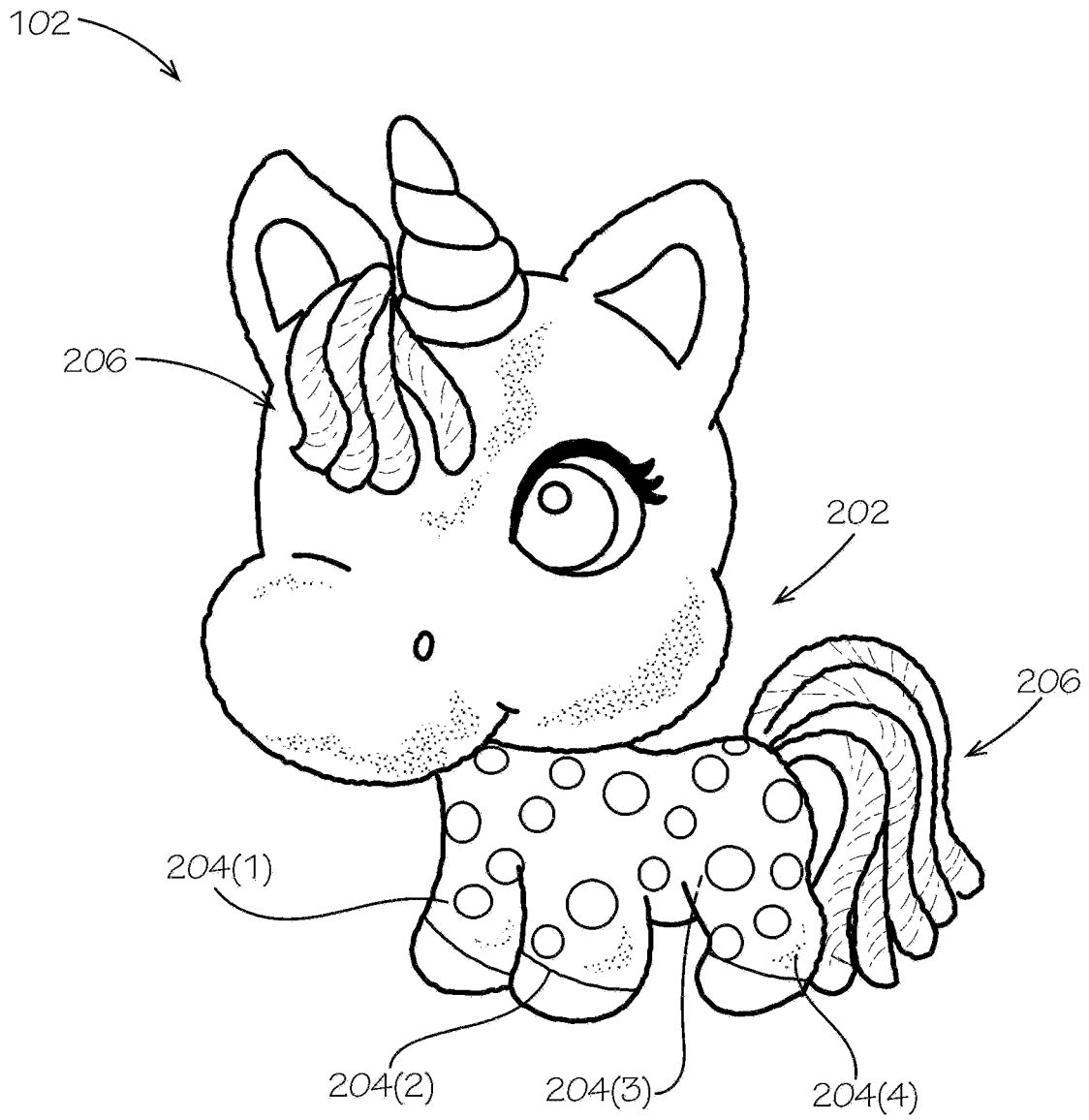
FIG. 2 is a partial perspective view illustrating one embodiment of an apparatus for a wound materials toy with internal figures and user engagement crafts.

FIG. 2 depicts one embodiment of a toy FIG. 102. As depicted in FIG. 2, the toy FIG. 102 may include a stuffed animal. The stuffed animal may include a cat, a dog, a bear, a tiger, a lion, a giraffe, a unicorn, an elephant, a horse, a cow, a pig, or some other animal. The toy FIG. 102 may include a body material disposed around a stuffing material. The body material may include low, medium, or high pile plush. The body material may include a velour. The body material may include some other type of fabric. The body material may include a printed pattern. In one or more embodiments, certain components of the toy FIG. 102 (such as an eye, eyelash, nostril, icons, etc.) may be embroidered on the body material. Other components may be sewn onto the body material.

In some embodiments, the stuffed animal figure may include a body 202. The stuffed animal figure may include one or more legs 204(1)-(4). The one or more legs 204(1)-(4) may extend away from the body 202. The one or more legs 204(1)-(4) may be foldable toward the body 202. In some embodiments, the one or more legs 204(1)-(4) may include less stuffing material than the amount of stuffing material in the body 202. The lesser amount of stuffing in the one or more legs 204(1)-(4) may assist the one or more legs 204(1)-(4) in folding toward the body 202. In some embodiments, the body 202 may include one or more strands 206 of material protruding from the body 202. The one or more strands 206 may be made of the same material as, have the same color(s) as, or otherwise be similar to the elongated wrapping member 106.

The toy FIG. 102 may include a shape other than a stuffed animal figure. For example, the toy FIG. 102 may include a person toy figure, an object toy figure, or some other toy figure. The toy FIG. 102 may include a toy other than a stuffed toy, such as an action figure.

Figure 3:
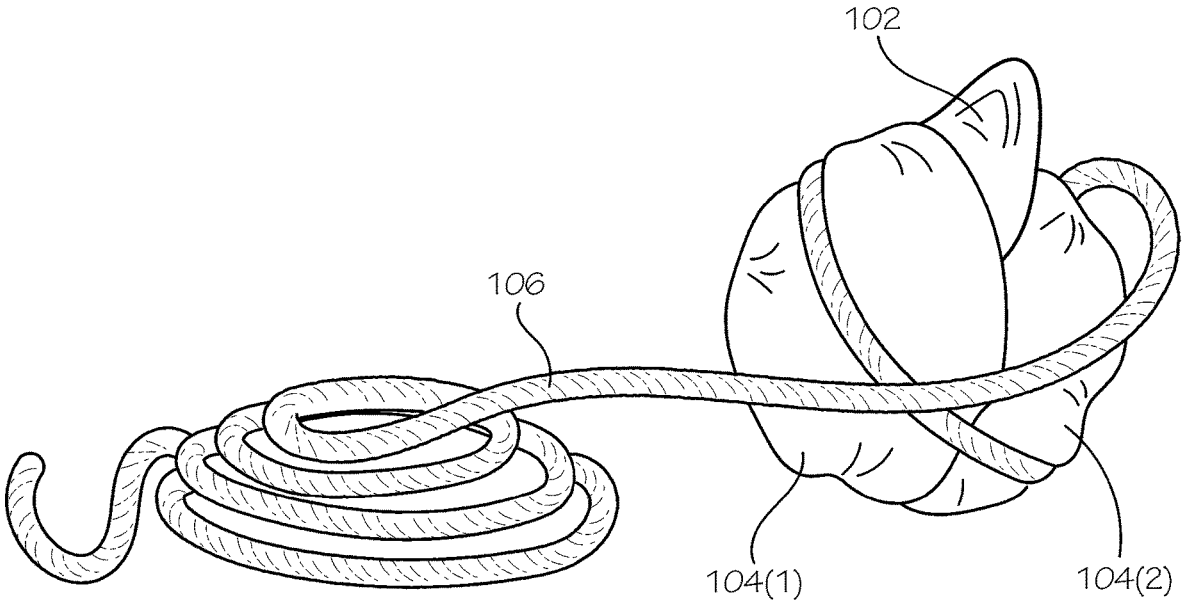
FIG. 3 is a partial perspective view illustrating one embodiment of an apparatus for a wound materials toy with internal figures and user engagement crafts.

FIG. 3 depicts the toy FIG. 102 with the one or more foldable coverings 104(1)-(2) disposed around the toy FIG. 102. As depicted in FIG. 3, in some embodiments, each of two foldable coverings 104(1)-(2) may be selectively disposed at least partially around the toy FIG. 102 and at least partially around a portion of the other foldable covering 104(1)-(2). In some embodiments, the toy FIG. 102 may be selectably disposed on top of the toy base 110, and then the one or more foldable coverings 104(1)-(2) may be disposed around the toy FIG. 102. The toy base 110 may provide support to the toy FIG. 102. The toy base 110 may include a U-shaped piece of material. The toy base 110 may include cardboard, plastic, wood, metal, or some other material.

In some embodiments, a foldable covering 104 may include a variety of shapes. A foldable covering 104 may include an oval shape, a rectangular shape, a triangular shape, a star shape (with multiple points, such as four, five, six, or more points), a cloud shape, or some other shape. The foldable covering 104 may include a planar piece of material. The foldable covering 104 may include cloth, cotton, yarn, acrylic, polyester, nylon, or some other material.

In one or more embodiments, the elongated wrapping member 106 may include a string. In some embodiments, the elongated wrapping member 106 may include a strip of fabric. The elongated wrapping member 106 may include a piece of fabric. The piece of fabric may include one of several shapes, such as an oval shape, rectangular shape, triangular shape, or some other type of shape. In one embodiment, the elongated wrapping member 106 may include a ribbon.

The elongated wrapping member 106 may include or be made out of one or more types of materials. The elongated wrapping member 106 may include cloth, cotton, yarn, acrylic, polyester, nylon, or some other material. In some embodiments, the first, second, and third elongated wrapping members 106(1)-(3) may each be made of different materials or may be made of the same material. The first, second, and third elongated wrapping members 106(1)-(3) may include different lengths, diameters, sizes, or dimensions. In some embodiments, such characteristics may all be the same across the first, second, and third elongated wrapping members 106(1)-(3). In some embodiments, the elongated wrapping member 106 may include a scarf, a bandana, a ribbon, or a nylon cord. The elongated wrapping member 106 may be at least partially disposed around the foldable covering 104.

In one embodiment, the first elongated wrapping member 106(1) and the second elongated wrapping member 106(2) may be detachably coupled together. One end of the first wrapping member 106(1) may be detachably coupled to an end of the second elongated wrapping member 106(2). For example, an end portion of the first wrapping member 106(1) may be tied to an end portion of the second wrapping member 106(2). An end of the third elongated wrapping member 106(3) may be detachably coupled to the other end of the second elongated wrapping member 106(2). The first, second, and third elongated wrapping members 106(1)-(3), when coupled together, may form a single elongated wrapping member.

In some embodiments, an elongated wrapping member 106 (e.g., the third elongated wrapping member 106(3)) may not be selectably coupled to another elongated wrapping member 106 but may still be disposed on the apparatus 100. For example, the third elongated wrapping member 106(3) may be disposed inside the ball formed by the foldable coverings 104(1)-(2) (e.g., as a ball of string), or the third elongated wrapping member 106(3) may be wrapped around the ball formed by the foldable coverings 104(1)-(2) but not selectably coupled to the first or second elongated wrapping members 106(1)-(2). In this manner, the user of the apparatus 100 may still use the third elongated wrapping member 106(3) to participate in a user engagement craft (e.g., forming a bracelet).

Figure 4:
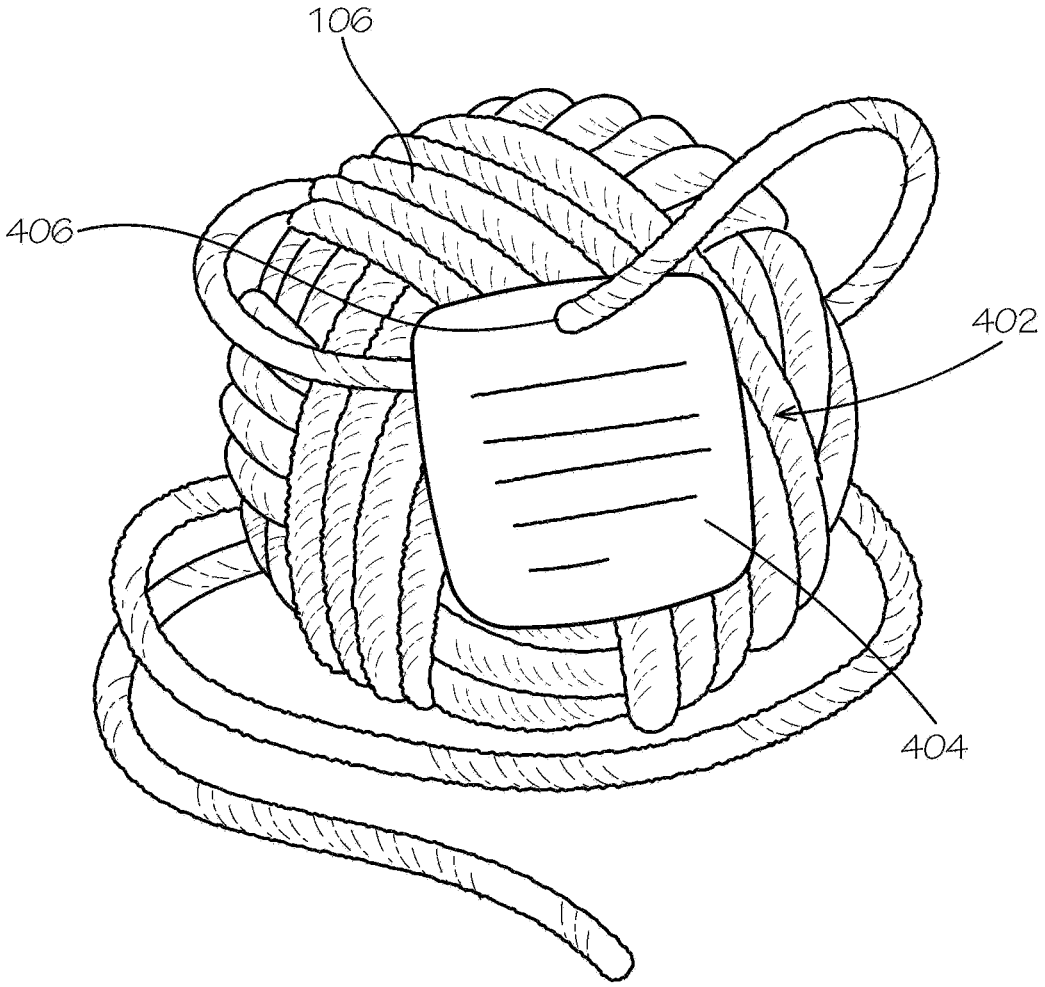
FIG. 4 is a partial perspective view illustrating one embodiment of an apparatus for a wound materials toy with internal figures and user engagement crafts.

FIG. 4 depicts the elongated wrapping member 106 selectably disposed around the toy FIG. 102 (not visible underneath the elongated wrapping member 106 in FIG. 4). The elongated wrapping member 106 may be wrapped around the toy FIG. 102 and itself to form a spherical ball, as is depicted in FIG. 4. A toy accessory 108 may be detachably disposed on the elongated wrapping member 106. The toy accessory 108 may include one or more apertures, and the elongated wrapping member 106 may penetrate through the aperture. The elongated wrapping member 106, when disposed against itself, may dispose the toy accessory 108 against the wrapped-up elongated wrapping member 106 and prevent the toy accessory from translating along the length of the elongated wrapping member 106.

In one embodiment, the toy accessory 108 may include an instruction booklet 402. The instruction booklet 402 may include a sheet 404 of material, such as plastic or paper, with printed text or images. The sheet 404 may include one or more folds. The folds may be arranged such that the instruction booklet 402 includes a book shape, an accordion shape, or some other shape. The instruction booklet 402 may include a aperture 406 disposed on the sheet 404. The elongated wrapping member 106 may penetrate the aperture 406.

Figure 5:
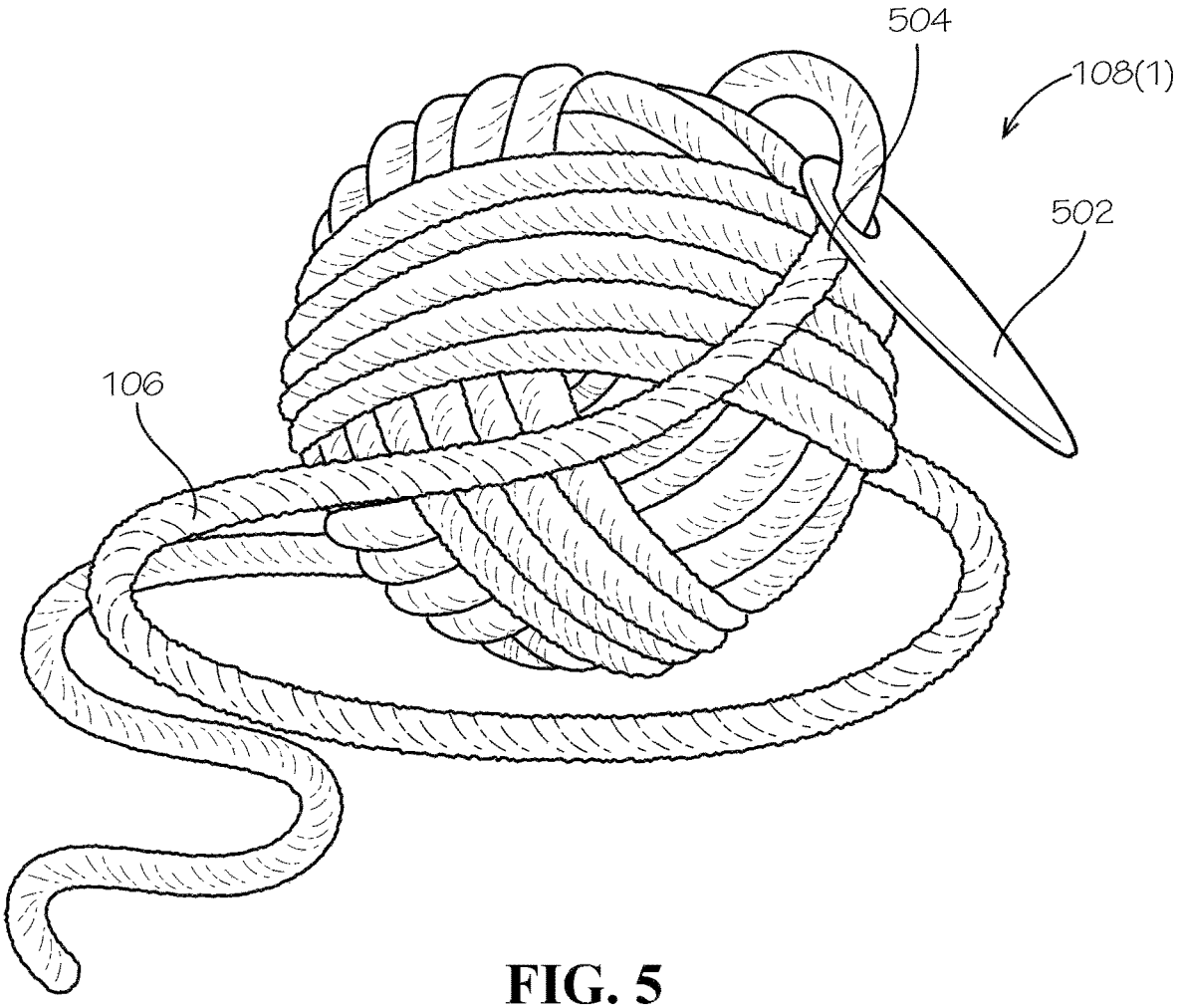
FIG. 5 is a partial perspective view illustrating one embodiment of an apparatus for a wound materials toy with internal figures and user engagement crafts.

As depicted in FIG. 5, in one embodiment, the toy accessory 108 may include the sewing needle 108(1). The sewing needle 108(1) may include a body portion 502. The body portion 502 may include an elongated piece of rigid material that tapers to a point. The point may be sharp or may be rounded. The sewing needle 108(1) may include an aperture 504, such as a threading aperture. The aperture 504 may disposed at an end of the body portion 502 that is located opposite the tapered point. The elongated wrapping member 106 may penetrate through the aperture 504.

Figure 6:
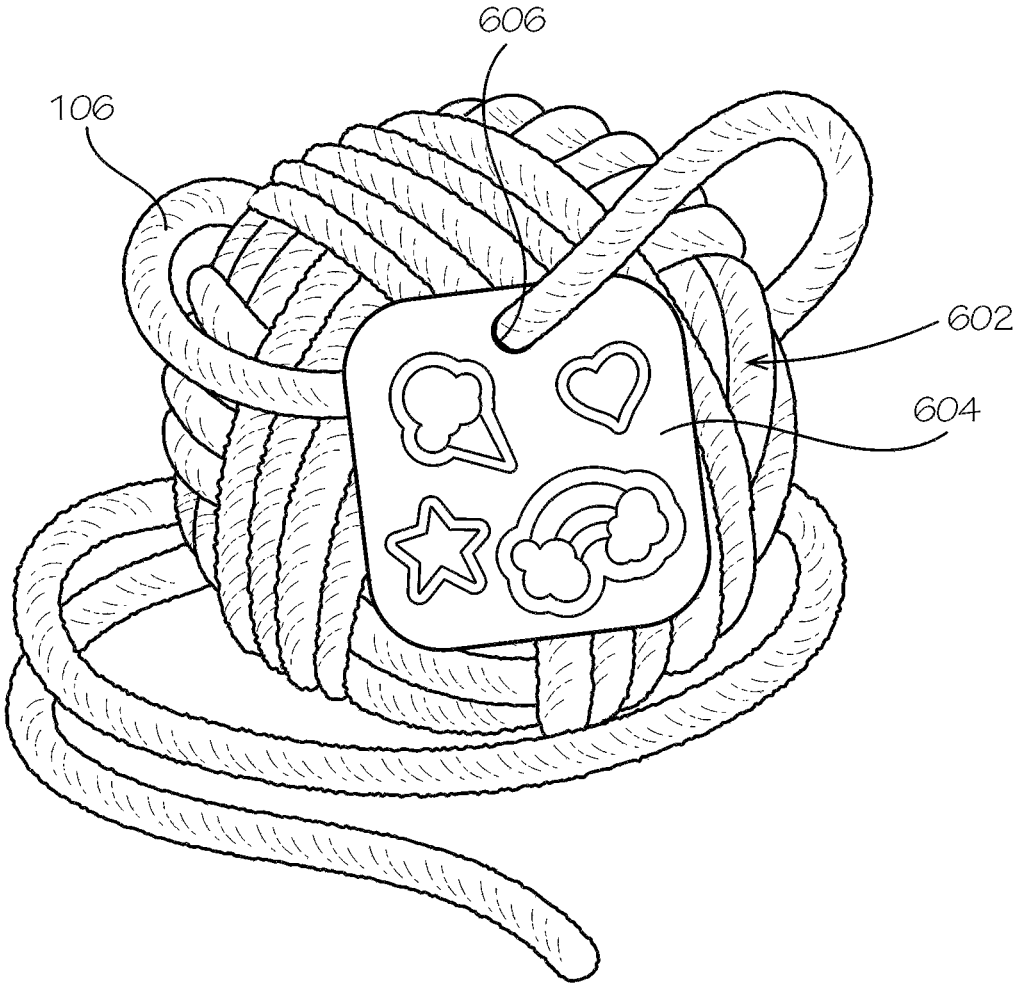
FIG. 6 is a partial perspective view illustrating one embodiment of an apparatus for a wound materials toy with internal figures and user engagement crafts.

As depicted in FIG. 6, the toy accessory 108 may include a sticker sheet 602. The sticker sheet 602 may include a sheet 604. The sheet 604 may include one or more stickers selectably disposed on the sheet 604 that a user may remove and adhere to another object. The sticker sheet 602 may include an aperture 606. The aperture 606 may be disposed on the sheet 604. The elongated wrapping member 106 may penetrate through the aperture 606.

Figure 7:
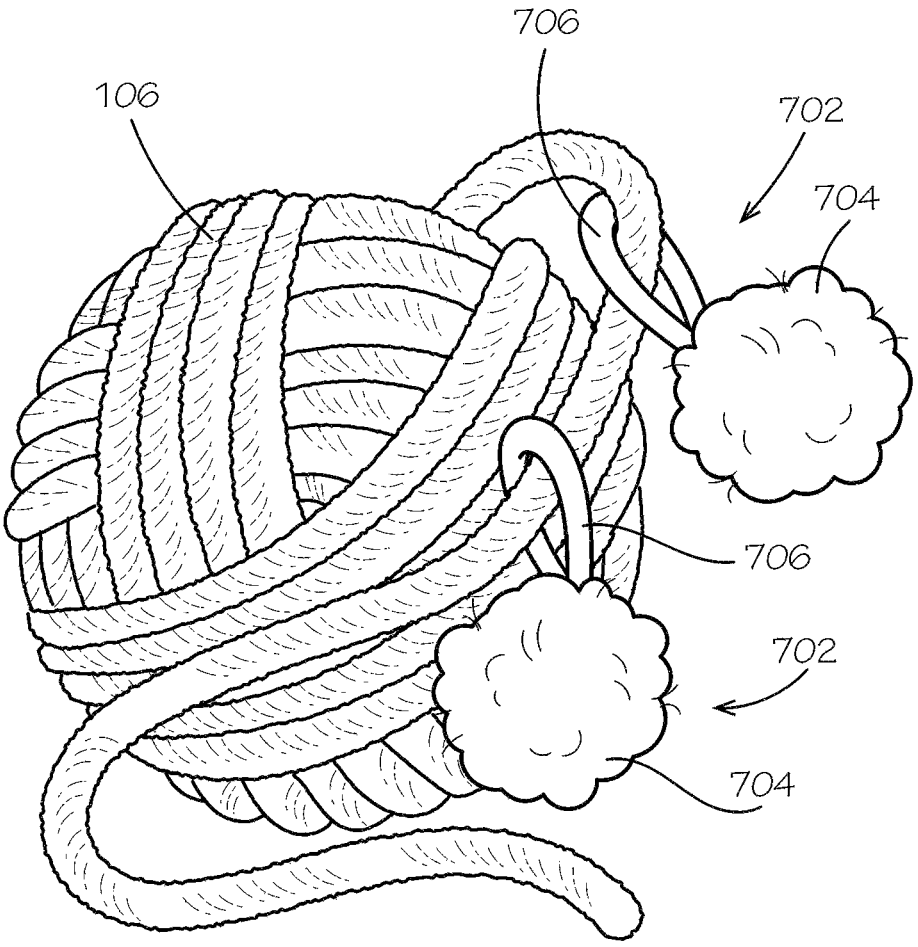
FIG. 7 is a partial perspective view illustrating one embodiment of an apparatus for a wound materials toy with internal figures and user engagement crafts.

As depicted in FIG. 7, the toy accessory 108 may include a pom-pom 702. The pom-pom 702 may include a body portion 704. The body portion 704 may include a soft, spherical material, as is depicted in FIG. 7. In other embodiments, the body portion 704 may include some other material disposable on the loop 706. The pom-pom 702 may include a loop 706 engaged with the body portion 704. The elongated wrapping member 106 may penetrate through the loop 706. One or more strands 206 of the toy FIG. 102 may penetrate the loop 706, which may selectably dispose a pom-pom 702 on the toy FIG. 102.

Figure 8:
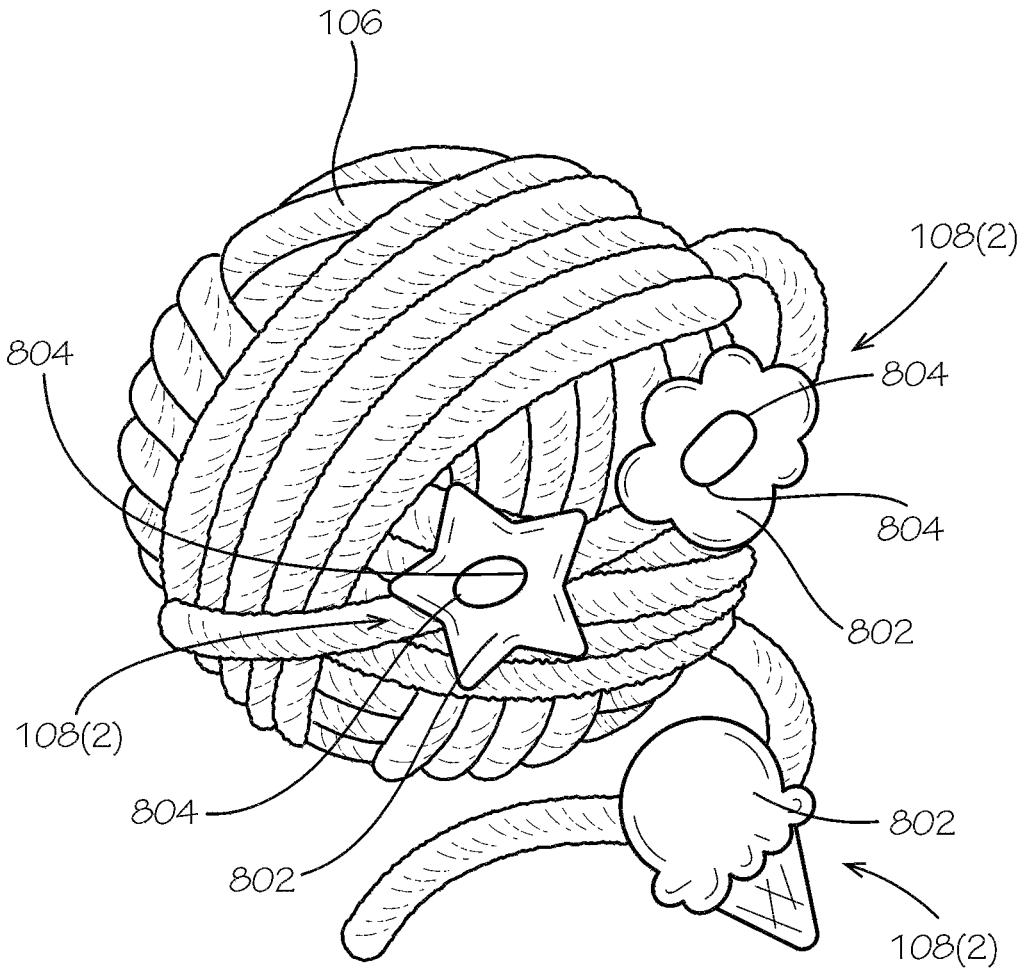
FIG. 8 is a partial perspective view illustrating one embodiment of an apparatus for a wound materials toy with internal figures and user engagement crafts.

In some embodiments, as depicted in FIG. 8, the toy accessory 108 may include the button 108(2). The button 108(2) may include a body portion 802. The body portion 802 may include a shape. The shape may include a star shape, a cloud shape, an ice cream shape, a circular shape (as depicted in FIG. 1), or some other shape. The body portion 802 may include a rigid material, such as plastic. The button 108(2) may include one or more apertures 804. The one or more apertures 804 may be disposed on the body portion 802. The elongated wrapping member 106 may penetrate through the apertures 804. As depicted in FIG. 8, in one embodiment, the elongated wrapping member 106 may penetrate through a first aperture 802, be selectably disposed along a portion of the body portion 802, and then penetrate a second aperture 802 in order to dispose the button 108(2) against the elongated wrapping member 106. In some embodiments, the button 108(2) may be selectably disposable on the strands 206 of the toy FIG. 102.

In some embodiments, the toy accessory 108 may include the name collar 108(3). The name collar 108(3) may include a name portion and a loop. The name portion may include a surface where a user may write or where a user may dispose a sheet of text, images, or other information. The loop may include an aperture that the elongated wrapping member 108 may penetrate.

The toy accessory 108 may include other types of toy accessories. In one or more embodiments, the toy accessory 108 may include other types of attachments that may detachably dispose the toy accessory 108 to the elongated wrapping member 106. For example, the toy accessory 108 may include a clip, a strand that may be tied around the elongated wrapping member, an adhesive, or some other type of attachment. The attachment may be in addition to an aperture 406, 504, 606, 804 or loop 706. The attachment may be an alternative to an aperture 406, 504, 606, 804 or loop 706.

Figure 9:
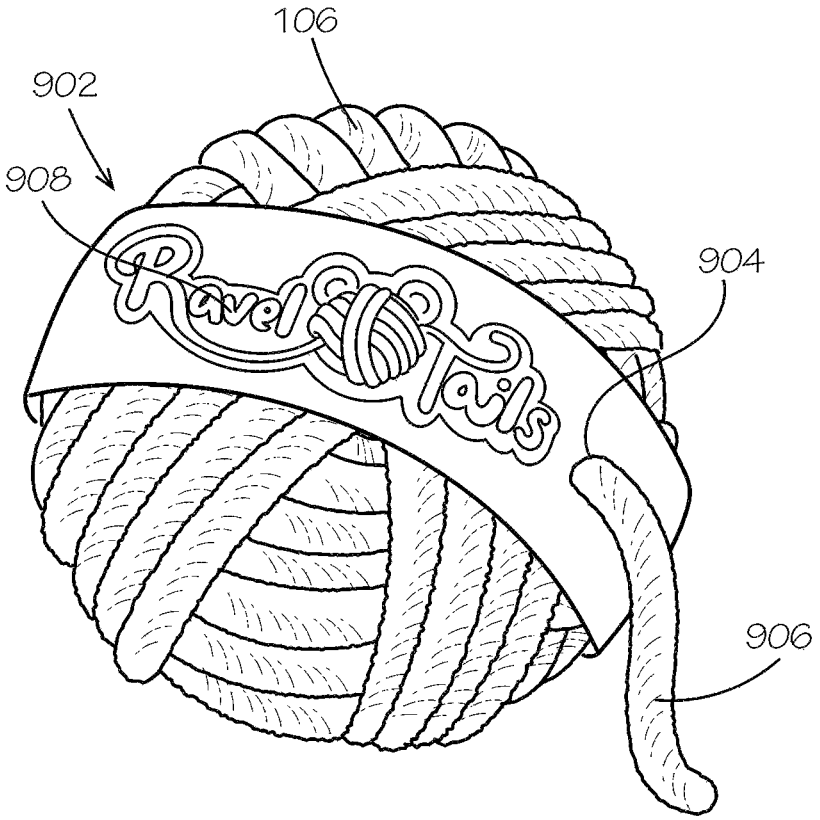
FIG. 9 is a partial perspective view illustrating one embodiment of an apparatus for a wound materials toy with internal figures and user engagement crafts.

In some embodiments, a single toy accessory 108 may be disposed on the elongated wrapping member 106. In other embodiments, multiple toy accessories 108 may be disposed on the elongated wrapping member 106. In some embodiments, the elongated wrapping member 106, when disposed around the toy FIG. 102, may cover the multiple toy accessories 108. The elongated wrapping member 106 coving the multiple toy accessories 108 may include the toy accessories 108 being completely covered and not being visible to a user (for example, as seen in FIG. 9). The multiple toy accessories 108 may be disposable in several different orders along the length of the elongated wrapping member 106. For example, as depicted in FIGS. 4-8, the instruction booklet 402 may be positioned on the elongated wrapping member 106 closest to the toy FIG. 102, the sewing needle 108(1) may be positioned on the elongated wrapping member 106 further away from the toy FIG. 102, then the sticker sheet 602, then the pom-pom 702, and then the button 108(2). In some embodiments, the instruction booklet 402 may be positioned on the elongated wrapping member 106 as the outermost toy accessory 108.

As can be seen from FIGS. 2-8, a user, such as a child, may obtain the toy FIG. 102 with the elongated wrapping member 106 disposed around the toy FIG. 102 (and, in some embodiments, the foldable covering 104) and the one or more toy accessories 108 disposed on the elongated wrapping member 106, as is depicted in FIG. 9. As the user unwinds the elongated wrapping member 106, the user may reveal the one or more toy accessories 108, as depicted in FIG. 8, FIG. 7, FIG. 6, FIG. 5, and FIG. 4. The user may detach the toy accessory 108 from the elongated wrapping member 106. For example, the user may slide the toy accessory 108 along the elongated wrapping member and remove the elongated wrapping member from the aperture 406, 504, 606, 804 or loop 706. Eventually, after unwinding the elongated wrapping member 104, the user may reveal the toy FIG. 102 (and the possible foldable covering 104), as depicted in FIG. 3. The user may remove the foldable covering 104 from the toy FIG. 102 and reveal the toy FIG. 102, as depicted in FIG. 2. As the user performs the unwinding and reveals the components of the apparatus 100, the user may experience enjoyment due to discovering the toy accessories 108 and the toy FIG. 102. The user may not know which specific toy accessories 108 or toy FIG. 102 will be revealed from the unwinding.

FIG. 9 depicts one embodiment of a band 902. The band 902 may be selectably disposed around the elongated wrapping member 106. The band 902 may include an aperture 904 disposed on the band 902. An end portion 906 of the elongated wrapping member 106 may be selectably disposed through the aperture 904. The band 902 may include a surface 908. The surface 908 may be disposed on a planar portion of the band 902. The surface 908 may include an area for disposing text, images, a logo, or other information.

Figure 10:
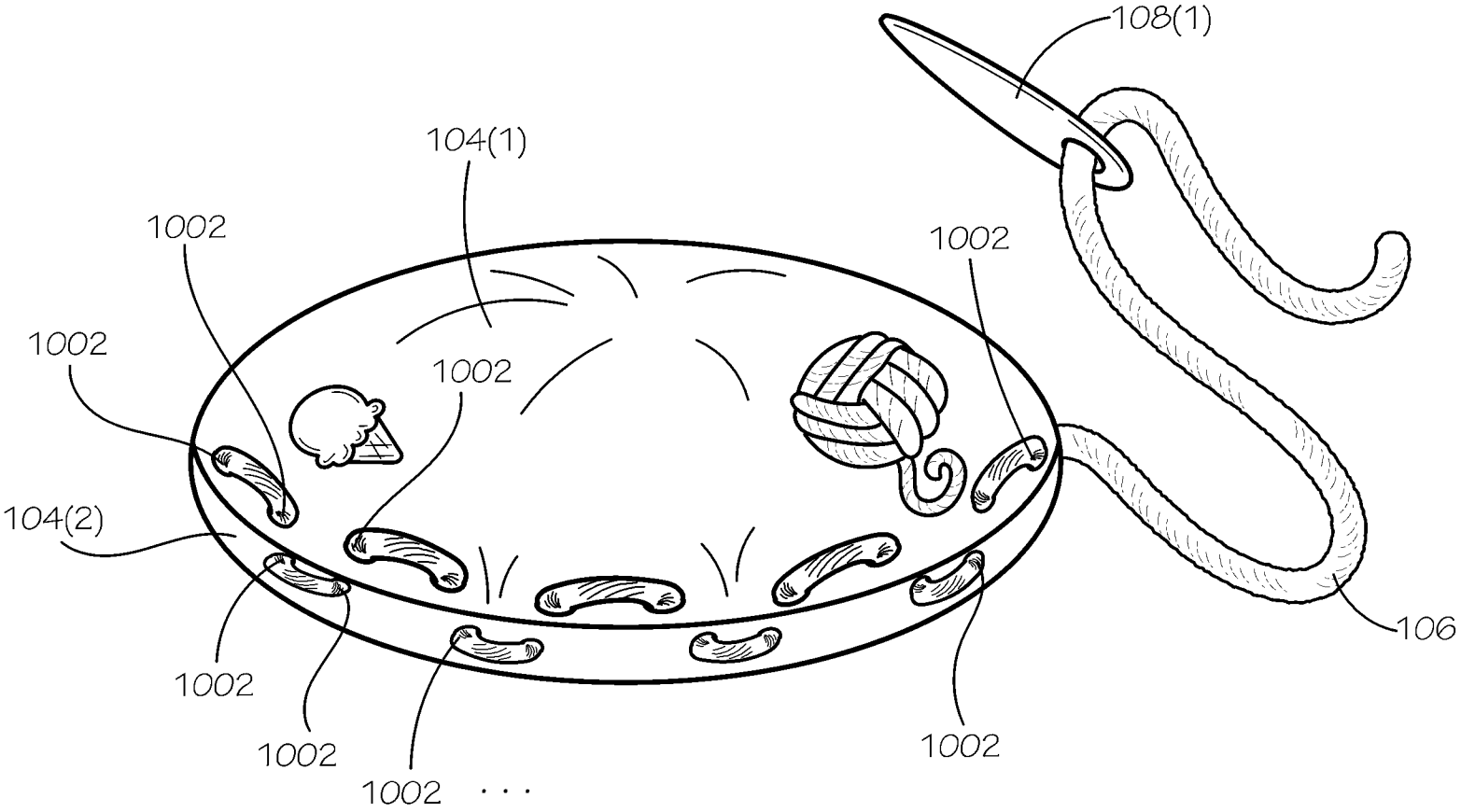
FIG. 10 is a partial perspective view illustrating one embodiment of an apparatus for a wound materials toy with internal figures and user engagement crafts.

FIG. 10 depicts one embodiment of the first foldable covering 104(1) and the second foldable covering 104(2). Each of the foldable coverings 104(1)-(2) may include multiple apertures 1002. The apertures 1002 may be disposed along an edge of the foldable covering 104. Each aperture 1002 may be sized for a diameter of the elongated wrapping member 106. The elongated wrapping member 106 may penetrate one or more apertures 1002. For example, as depicted in FIG. 10, a user may thread the needle 108(1) with the elongated wrapping member 106 and may sew the first foldable covering 104(1) and the second foldable covering 104(2) together via the elongated wrapping member 106 and the apertures 1002. The first and second foldable coverings 104(1)-(2), when sewn together, may form a pouch. Various objects, such as one or more of the toy accessories 108, other elongated wrapping members 106, or the toy FIG. 102, may be disposed in the pouch. In some embodiments, a user may sew the elongated wrapping member 106 around the entire circumference of the foldable covering 104. In other embodiments, the user may sew the elongated wrapping member 106 partially around the circumference of the foldable covering 104 and form a pocket with an opening.

Figure 11:
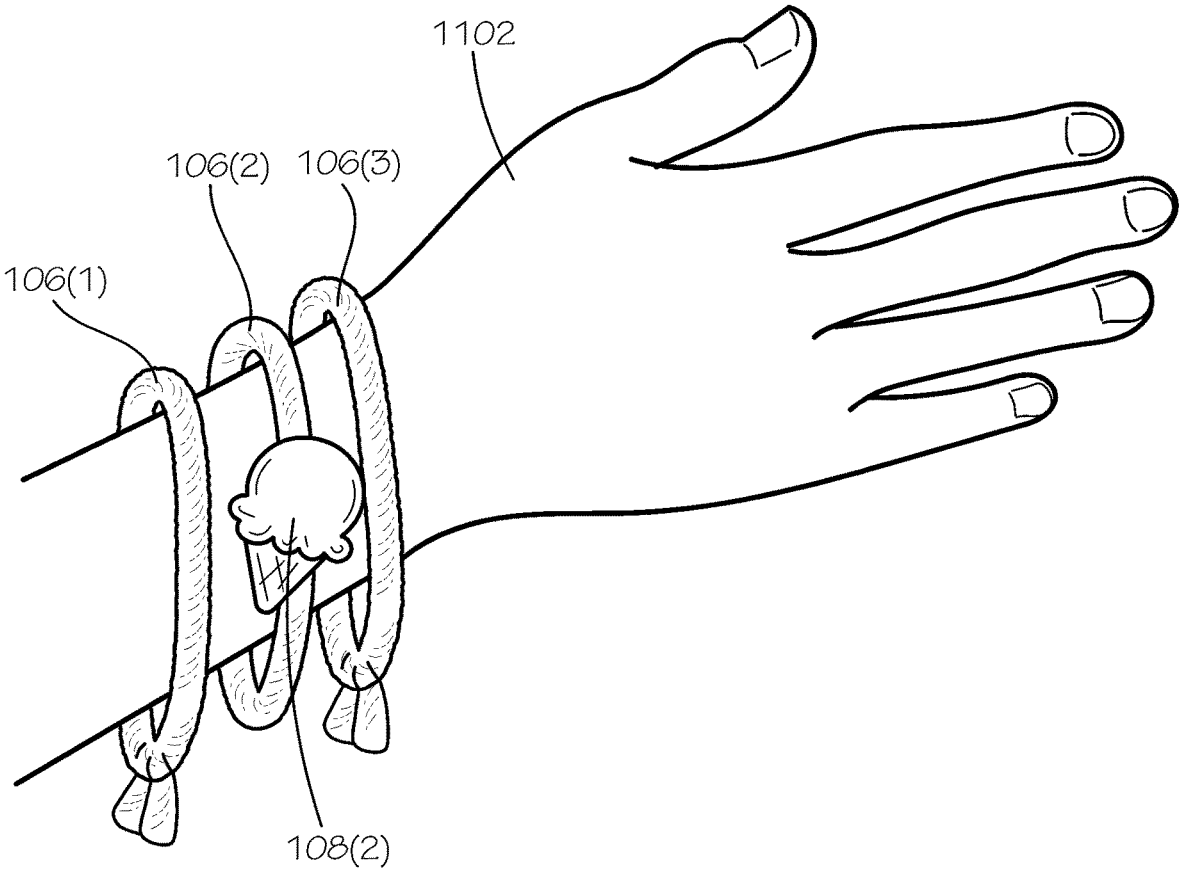
FIG. 11 is a partial perspective view illustrating one embodiment of an apparatus for a wound materials toy with internal figures and user engagement crafts.

FIG. 11 depicts components of the apparatus 100 in use as bracelets. Each of the first, second, and third elongated wrapping members 106(1)-(3) may be tied to itself at its ends in loop around the wrist of a user 1102. A toy accessory 108 may be detachably disposed on an elongated wrapping member 106. For example, as shown in FIG. 11, the second elongated wrapping member 106(2) may penetrate through the one or more apertures 702 of the button 108(2) toy accessory in order to selectably dispose the button 108(2) on the second elongated wrapping member 106(2). In some embodiments, only the first elongated wrapping member 106(1) may be used to form a bracelet, or only the first and second elongated wrapping members 106(1)-(2) may form bracelets. In other embodiments, more than three elongated wrapping members 106(1)-(3) may form bracelets. Multiple elongated wrapping members 106(1)-(3) may be wound around each other to form a bracelet. For example, two elongated wrapping members 106(1)-(2) may be braided together to form a braided elongated wrapping member.

FIGS. 10 and 11 depict possible uses for the foldable covering 104, the elongated wrapping member 106, or a toy accessory 108 other than as packaging for the toy FIG. 102 or the toy accessory 108. Other uses are also contemplated as within the scope of the disclosure.

Figure 12:
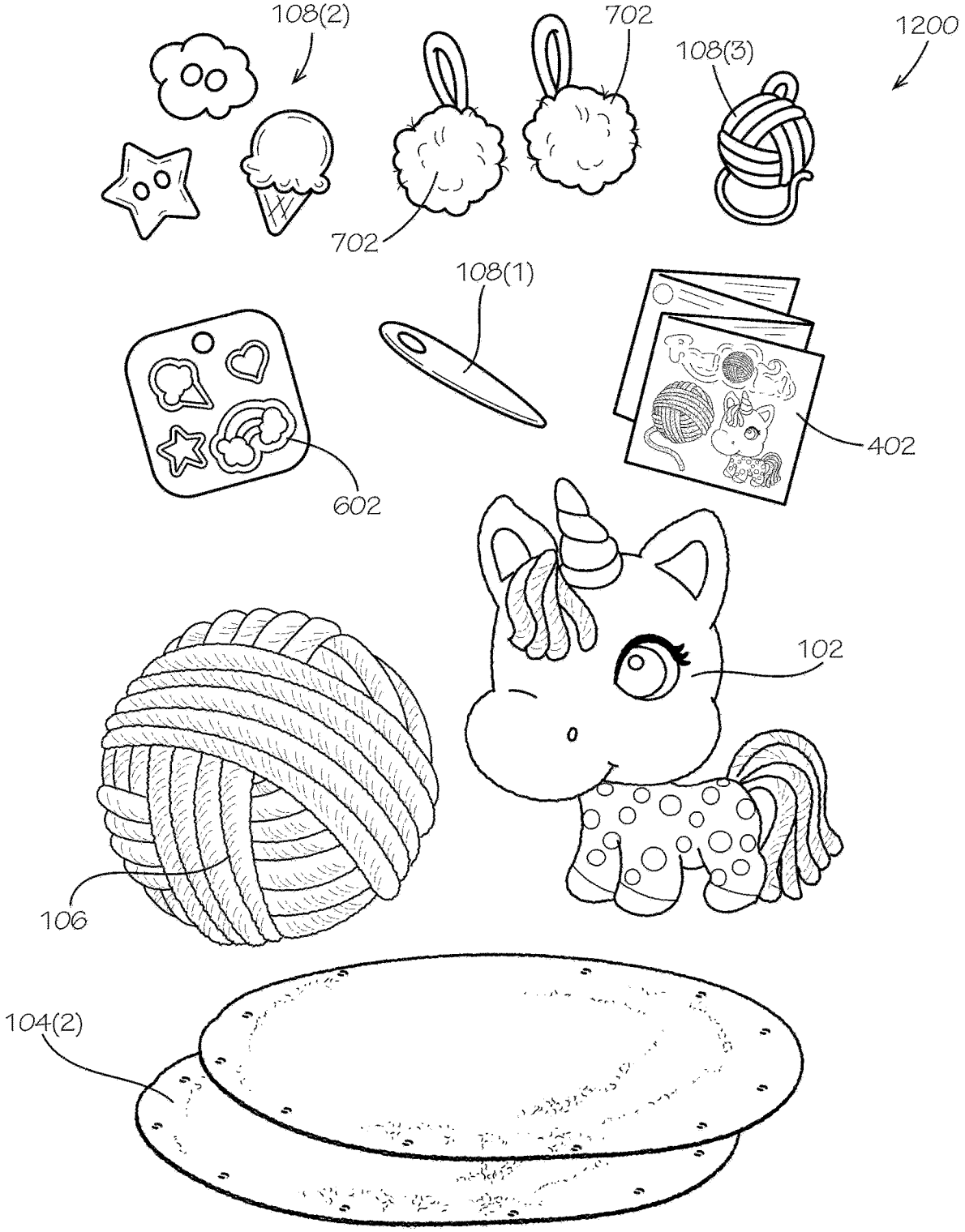
FIG. 12 is a perspective view illustrating one embodiment of an apparatus for a wound materials toy with internal figures and user engagement crafts.

FIG. 12 depicts another embodiment of an apparatus 1200. The apparatus 1200 may include an apparatus for a wound materials toy with internal figures and user engagement crafts. The apparatus 1200 may include the toy FIG. 102. The toy FIG. 102 may include a stuffed animal figure. The apparatus 1200 may include the foldable covering 104 (e.g., the first foldable covering 104(1) and the second foldable covering 104(2)). The foldable covering 104 may be selectably disposable around the toy FIG. 102. The apparatus 1200 may include the elongated wrapping member 106. The elongated wrapping member 106 may be selectably disposable around the foldable covering 104. The elongated wrapping member 106, when selectably disposed around the foldable covering 104, may at least partially cover the foldable covering 104 and form a spherical ball. The apparatus 1200 may include a plurality of toy accessories 108(1)-(3), 402, 602, and 702. The plurality of toy accessories 108(1)-(3), 402, 602, 702 may be detachably disposed on the elongated wrapping member 106. The elongated wrapping member 106, when disposed around the toy FIG. 102, may at least partially cover the plurality of toy accessories 108(1)-(3), 402, 602, 702.

Figure 13:
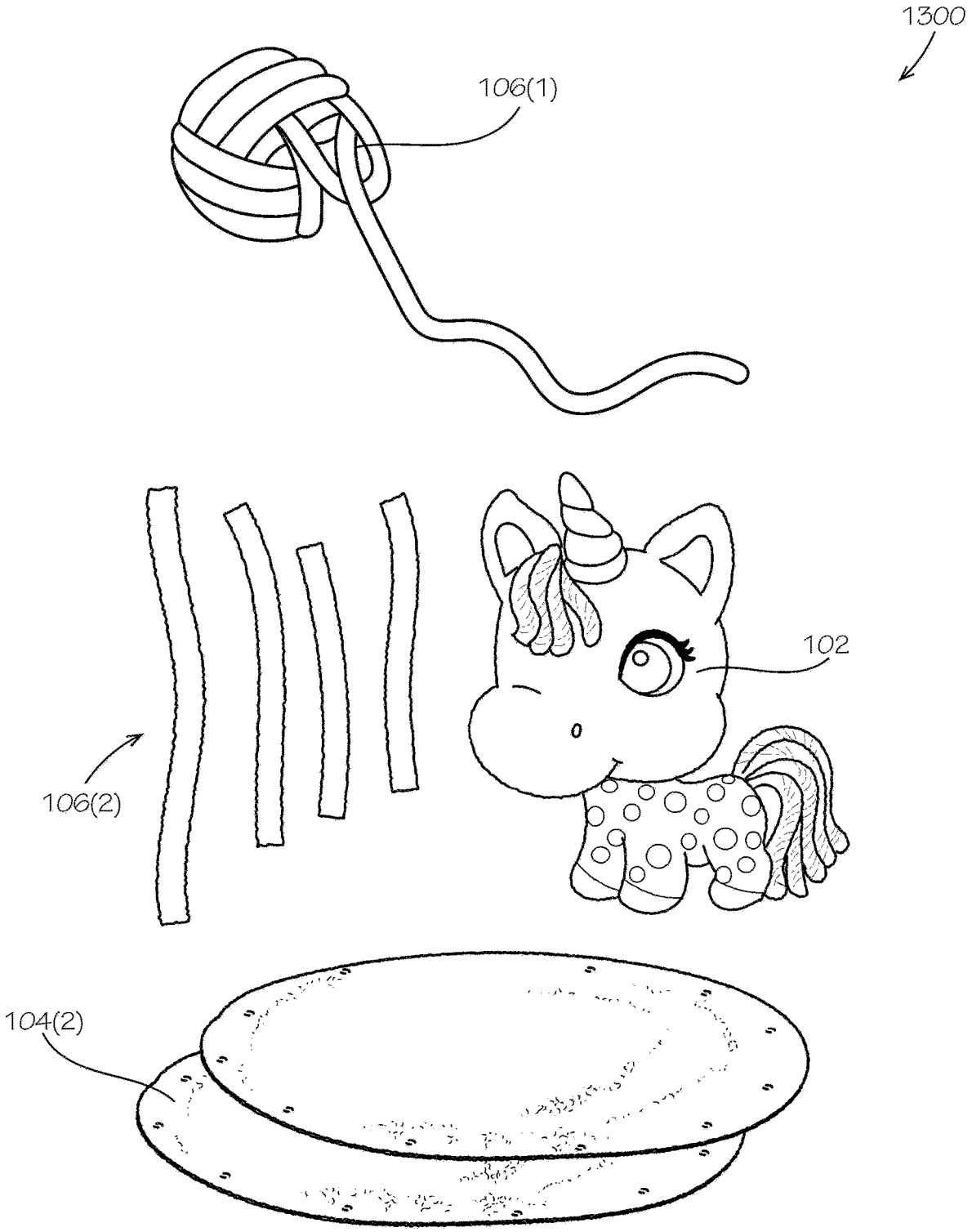
FIG. 13 is a perspective view illustrating another embodiment of an apparatus for a wound materials toy with internal figures and user engagement crafts.

FIG. 13 depicts another embodiment of an apparatus 1300. The apparatus 1300 may include an apparatus for a wound materials toy with internal figures and user engagement crafts. The apparatus 1300 may include the toy FIG. 102. The toy FIG. 102 may include a stuffed animal figure. The apparatus 1300 may include the foldable covering 104 (e.g., the first foldable covering 104(1) and the second foldable covering 104(2)). The foldable covering 104 may be selectably disposable around the toy FIG. 102. The apparatus 1300 may include the first elongated wrapping member 106(1). The first elongated wrapping member 106 (1) may include a long strip of material such as yarn. The apparatus 1300 may include the second elongated wrapping member 106(2). The second elongated wrapping member 106(2) may include one or more strips of fabric. In some embodiments, multiple strips of fabric of the second elongated wrapping member 106(2) may selectably couple together (e.g., may be tied together) to form a single elongated wrapping member 106(2). The second elongated wrapping member 106(2) may selectably couple with the first elongated wrapping member 106(1). The apparatus 1300 may include at least some of the plurality of toy accessories 108(1)-(3), 402, 602, 702 (not shown in FIG. 13).

Thus, although there have been described particular embodiments of the present disclosure of a new and useful WOUND MATERIALS TOY WITH INTERNAL FIGURES AND USER ENGAGEMENT CRAFTS, it is not intended that such references be construed as limitations upon the scope of this disclosure.

What is claimed is:

1. An apparatus, comprising:

a toy figure, wherein the toy figure includes a stuffed animal figure, and wherein the stuffed animal figure includes a body, and a plurality of legs extending away from the body, wherein the plurality of legs are foldable toward the body;

a foldable covering selectably disposed around the toy figure;

an elongated wrapping member selectably disposed around the foldable covering and toy figure, wherein the elongated wrapping member, when selectably disposed around the foldable covering, at least partially covers the foldable covering and toy figure and forms a spherical ball; and a plurality of toy accessories detachably disposed on the elongated wrapping member, wherein the elongated wrapping member, when disposed around the foldable cover and the toy figure with the plurality of toy accessories thereon, at least partially covers the plurality of toy accessories, and the plurality of toy accessories include an instruction sheet, and a sewing needle.

* * * * *